United States Patent [19]

Appelbaum et al.

[11] 4,008,827

[45] Feb. 22, 1977

[54] CONTAINER FOR VENDING MACHINES

[75] Inventors: Paul Appelbaum, Roswell, N. Mex.; Cecil J. Rhodes, Mesa, Ariz.

[73] Assignee: Cartridge Vending Systems, Inc., Roswell, N. Mex.

[22] Filed: Dec. 3, 1975

[21] Appl. No.: 637,109

[52] U.S. Cl. ..... 221/197

[51] Int. Cl.[2] ..... B65H 1/00

[58] Field of Search ..... 221/197, 287, 270, 271, 221/129

[56] References Cited

UNITED STATES PATENTS

| | | | |
|---|---|---|---|
| 2,825,488 | 3/1958 | Nelson | 221/67 |
| 3,486,658 | 12/1969 | Cheslak et al. | 221/197 |

*Primary Examiner*—Allen N. Knowles

*Attorney, Agent, or Firm*—Fulwider Patton Rieber Lee & Utecht

[57] ABSTRACT

A normally closed cartridge container for storing various vended articles and adapted for insertion into a vending machine. The container includes a hinged transverse door, proximate the bottom thereof, for allowing withdrawal of the articles from the interior thereof following insertion of the container into the vending machine. Prior to insertion, the transverse door is maintained closed by a first leaf spring engaging a first detent on the periphery of a cam attached to the door. After insertion, a second leaf spring is urged against the cam to engage a second detent when the door is rotated to an open position by a rack and pinion driven by a first solenoid. In a first embodiment, the first and second solenoids are concurrently energized across a micro-switch closed by a door in the vending machine at insertion of the container, the second solenoid urging the first leaf spring out of the first detent. The first solenoid then articulates the transverse door, which upon reaching a fully open position, is engaged thereat by the second leaf spring. In a second embodiment, the inventive cartridge container is included in an attended vending machine which therefore is interlocked to an open position by a lock assembly and which furthermore is rendered operative without any coin insertion.

10 Claims, 11 Drawing Figures

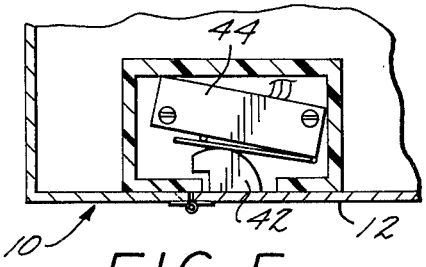
FIG. 5
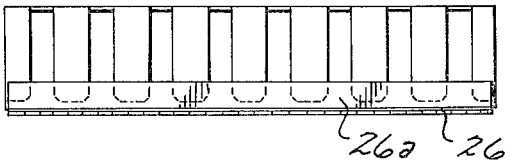
FIG. 8
FIG. 6
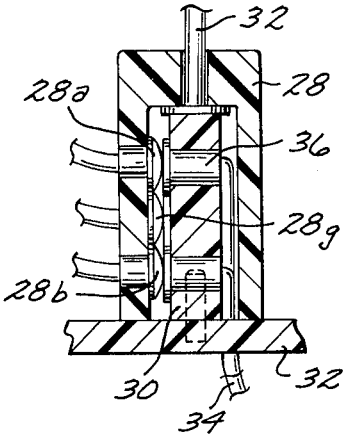
FIG. 7
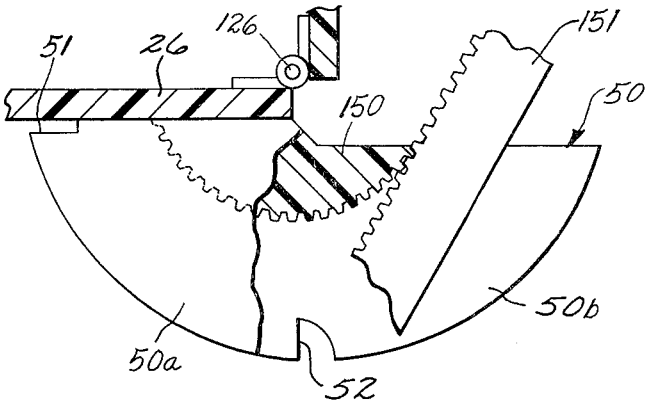
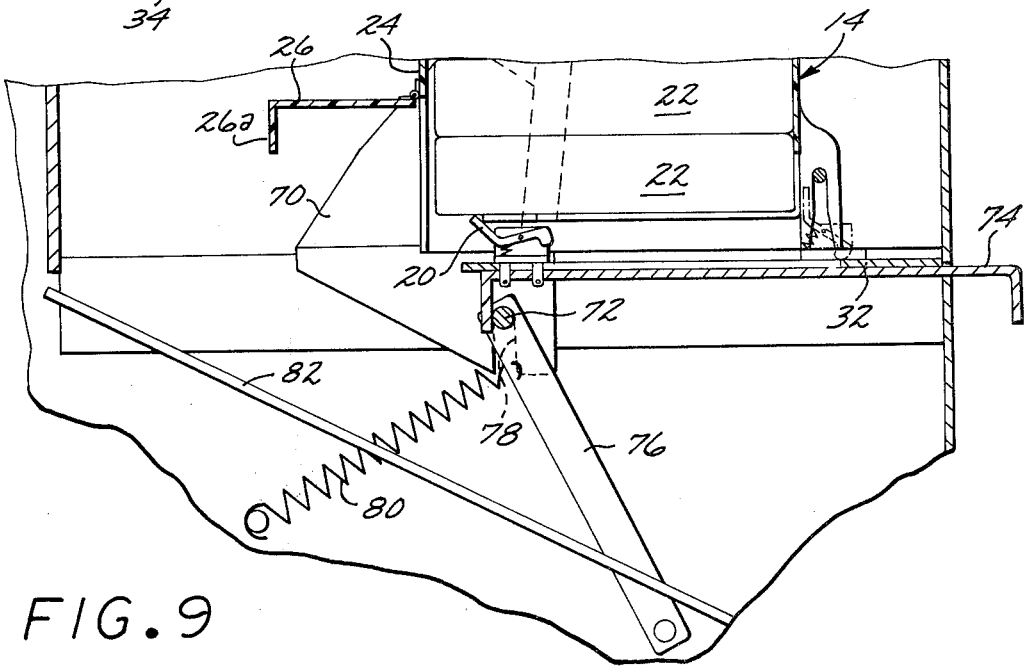
FIG. 9

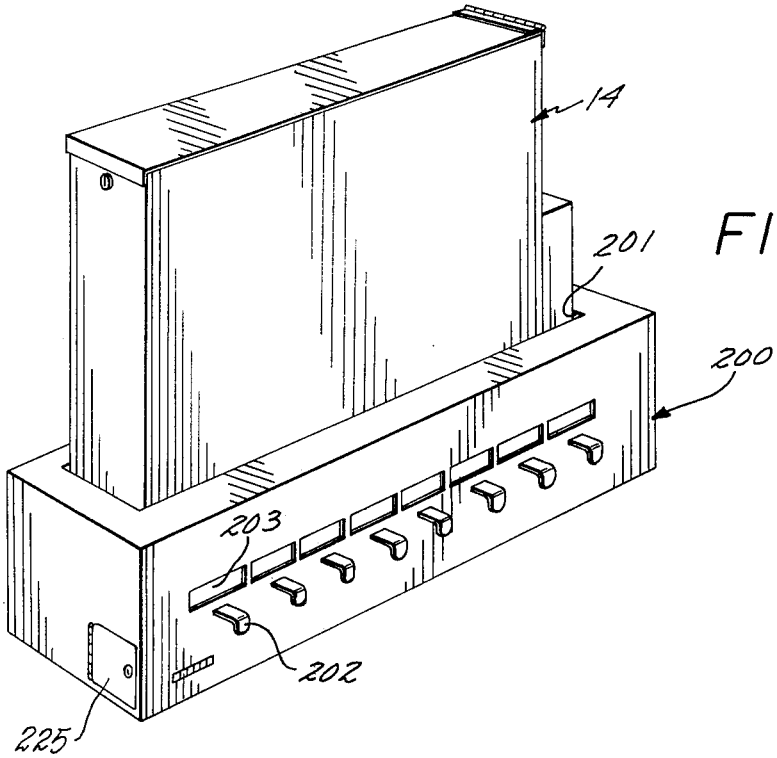
FIG. 10
FIG. 11
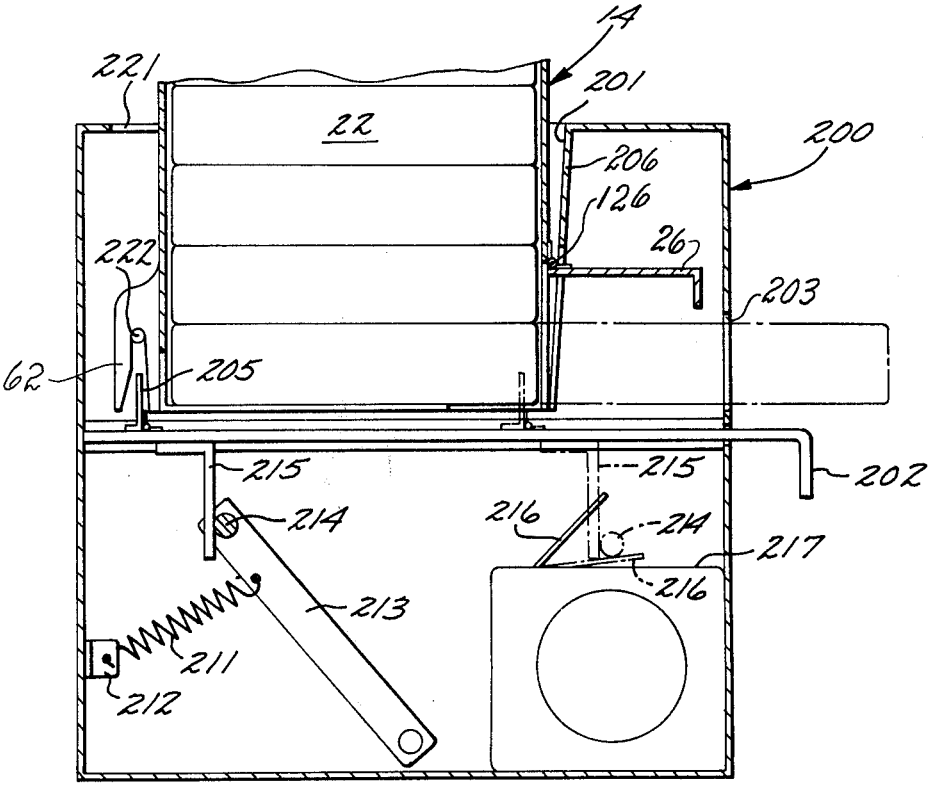

CONTAINER FOR VENDING MACHINES

BACKGROUND OF THE INVENTION

1. Field of the Invention

The present invention relates to vending machines, and more particularly to vending machines including cartridge containers for replacing the dispensed articles therein.

2. Description of the Prior Art

Vending machines have, in the recent past, acquired great popularity, particularly for sales of articles of relatively low cost and therefore low profit. In such applications, a vending machine offers great economies over counter sales, since no personal attendance is required. The main source of manual labor still remaining is that involved in either inventory accounting or in the periodic resupply of inventory within the vending machine. In order to centralize the task of accounting and furthermore to reduce the opportunity for pilferage by employees, replacement of inventory by way of cartridge containers has been found advantageous. One such vending machine with removable containers is described in U.S. Pat. No. 3,486,658. This reference teaches a mechanically interlocked vending machine and is therefore particularly adapted for use where fully mechanically articulated vending machines are intended. Where, however, electrical power is available, electro-mechanical interlocks offer many advantages, both in the convenience of operation and in the capability of remote control thereover.

SUMMARY OF THE INVENTION

Accordingly, it is the general purpose and object of the present invention to provide a vended article cartridge container including an interlock mechanism mechanically biased to a locked state when outside of the vending machine and electro-mechanically articulated to an open state upon insertion therein.

Other objects of the invention are to provide a vended article cartridge container which includes normally closed electro-mechanical locking means on the interior thereof adapted to be opened upon insertion into a vending machine.

Yet further objects of the invention are to provide a cartridge container interlock which responds to a particular combination of electrical excitation contacts and which furthermore will not respond to any other combinations.

Briefly, these and other objects are accomplished within the present invention by providing a cartridge container adapted to store in either rows or columns various vended articles, such container being conformed for receipt within the interior of a vending machine. The container is formed in a manner of a rectangular housing comprising sheet metal walls and having the upper surface thereof hinged for opening and conventionally locked, thus allowing for convenient reloading of the container at some central location. At the bottom surface, the container includes a dispensing opening normally closed by a transverse hinged door which is electro-mechanically rotated to an open position upon insertion of the container into the vending machine.

More specifically, the vending machine is provided with a key assembly comprising a plurality of exposed electrical terminals, a selected number of which are connected for electrical excitation. A corresponding set of pre-aligned contacts is included within the keyway in the container at a position opposing those terminals in the vending machine which are connected for excitation. Thus upon insertion of the container into the vending machine, electrical continuity is made between the terminal and contacts to excite appropriate electro-mechanical devices in an interlock housing.

In order to limit the duration of the power applied to such electro-mechanical devices, the vending machine is further provided with a momentary closure microswitch ahead of the terminals, the microswitch being closed by a cam projecting from the transverse door of the vending machine when such door is in a closed position. In this manner, the appropriate terminals of the key assembly are momentarily excited only during the time interval between insertion of the container and the subsequent automatically occurring opening of the transverse door after insertion.

In order to effect a normally closed interlock, the container is provided, within the interlock housing, with yet another semicircular cam attached to one vertical edge of the transverse door, the cam having a first detent engaged by a leaf spring for maintaining the transverse door closed and a second detent exposed for engagement with a second leaf spring for maintaining the transverse door in an open position. The first leaf spring is normally biased against the peripheral edge of the semicircular cam to normally engage the first, or the locking, detent. The second leaf spring is normally biased away from the peripheral edge of the semicircular cam and is disposed to be driven against the cam by a pin extended into the vending machine. Thus, the second leaf spring will engage a second detent in the cam only after insertion of the container into the vending machine.

In this manner, the container is normally closed by the spring bias of the first leaf spring. Upon insertion of the container into the interior of the vending machine, the pin projecting through a keyway is opposed by the key assembly and is translated into the interior of the container to force the second leaf spring against the peripheral edge of the cam surface. Furthermore, when appropriate alignment is made between the contacts and the exposed terminals of the key assembly, electrical excitation is applied to a first solenoid which then extends to provide an opposing force to the first leaf spring, withdrawing the spring from the first detent. The transverse door is thus freed for articulation. A second linear solenoid is concurrently also excited, extending a rack across a pinion segment concentrically attached to the cam to rotate the transverse door to an open position. When the door is thus rotated to an open position, the second detent thereof is aligned to engage the second leaf spring which is forced against the cam by the translating pin to lock the door in an open position. The excitation to the key assembly is then removed by the concurrent opening of the microswitch. Upon withdrawal, the pin projecting into the keyway is free to translate away from the second leaf spring and the normal bias thereof withdraws the leaf spring from the second detent. The bottom closure surface is then free to drop to a closed position to be engaged thereat by the first leaf spring. In this manner, an electro-mechanical interlock is provided within the structure of a cartridge container, such interlock forming a convenient assembly for both articulation and locking of the bottom transverse door which exposes the articles for dispensing.

BRIEF DESCRIPTION OF THE DRAWINGS

FIG. 5 is a partial cross sectional view illustrating a microswitch adapted to be articulated by elements of FIG. 3;

FIG. 6 is a sectional view of an inventive keyway adapted for use with the present invention;

FIG. 7 is a partial sectional view taken to illustrate an inventive semicircular cam in combination with a rack and pinion element;

FIG. 8 is a bottom view of the inventive cartridge container;

FIG. 9 is a side view, in partial cross section, illustrating one selector mechanism adapted for use with the present invention;

FIG. 10 is a perspective view of yet another embodiment of a vending machine incorporating the inventive cartridge container; and FIG. 11 is a sectional side view of the embodiment shown in FIG. 10.

DESCRIPTION OF THE SPECIFIC EMBODIMENT

The following description is particularly directed at illustrating the inventive concept in combination with a cigarette vending machine. While the invention is of particular utility in this type of vending machine, other uses therefor are contemplated and no intent to limit the scope of the claims thereof is intended hereby. Further, the following description is illustrated with a column arrangement of the vended articles adapted to progress into alignment for selection by gravity. Such illustration is for purposes of clarity only and again other arrangements, such as row arrangement, of the vended articles is contemplated.

Figure 1:
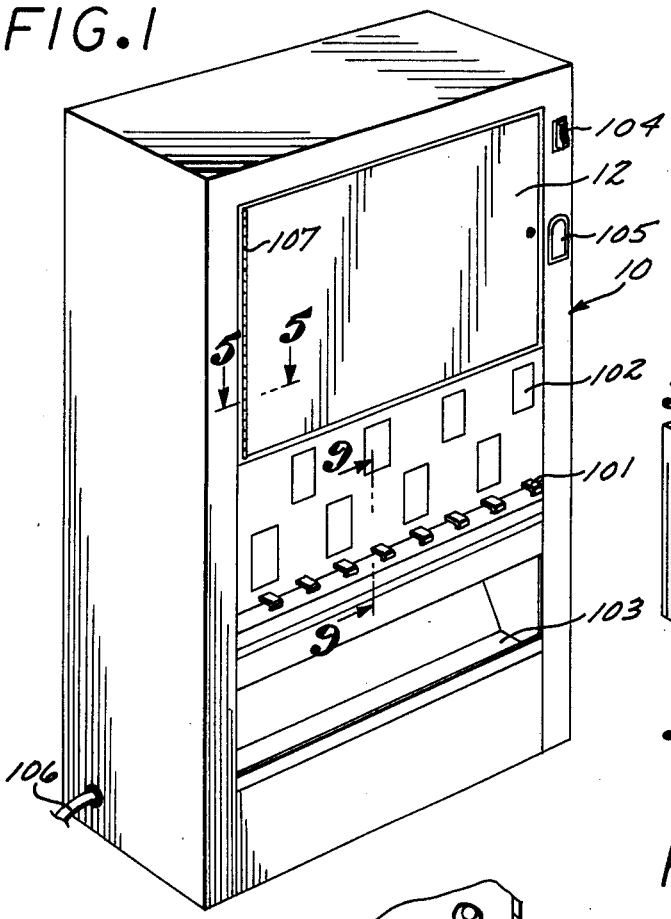
FIG. 1 is a perspective view of a vending machine adapted for use with a cartridge container according to the present invention.
Figure 2:
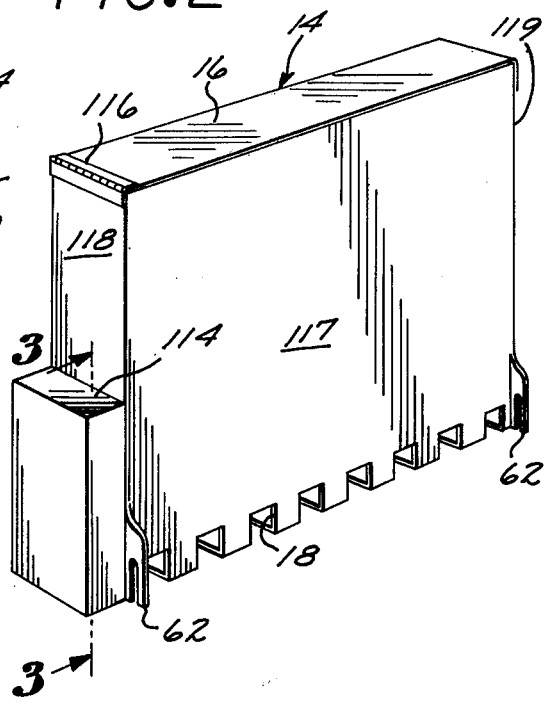
FIG. 2 is a perspective view of a vended article cartridge container adapted for insertion into the vending machine of FIG. 1.

As shown in FIG. 1, a vending machine, generally designated by the numeral 10, is provided with a rectangular front closure 12, hinged along one vertical edge and locked at the opposite edge, for receiving the inventive cartridge container, generally designated by the numeral 14 in FIG. 2. The external structure of the vending machine 10, with the exception of closure 12, is essentially conventional, including a plurality of selector tabs 101 disposed on the front thereof in alignment below a plurality of corresponding decals 102, which in the instance of a cigarette vending machine would illustrate the particular brand name and type of the cigarette dispensed by the articulation of the corresponding tab. Tabs 101 are arranged in a row above a chute 103 into which the dispensed cigarette packages are dropped. The vending machine 10 further includes on the upper edge thereof a coin slot 104 and a coin return chute 105, both configured and operating in the conventional manner. Also connected to one lateral surface of the vending machine 10 is a conventional power cord 106 adapted for insertion into any electrical power outlet (not shown).

As stated above, vending machine 10 includes the front closure 12, the closure being hinged along a piano hinge 107 along one vertical edge thereof and locked at a lock 108 at the opposing vertical edge. The dimensions of the closure 12 are conformed to pass the cartridge container 14 in and out of the interior of machine 10. The cartridge container 14 is assembled from sheet metal surfaces, each essentially rectangular in planform, the lateral surfaces being conformed to the longitudinal dimension of the vended articles. At the upper surface, the cartridge container 14 includes a hinged access door 16 attached along one short horizontal edge across a piano hinge 116 to one vertical side surface 118. The other end of door 16 is locked in a conventional manner to the opposing vertical surface 119, to be opened for loading of the vended articles at some central location. Attached along the exterior of the vertical side surface 118 is an interlock housing 114 again conformed as a rectangular enclosure joined along one vertical surface with the cartridge container 14.

Figure 3:
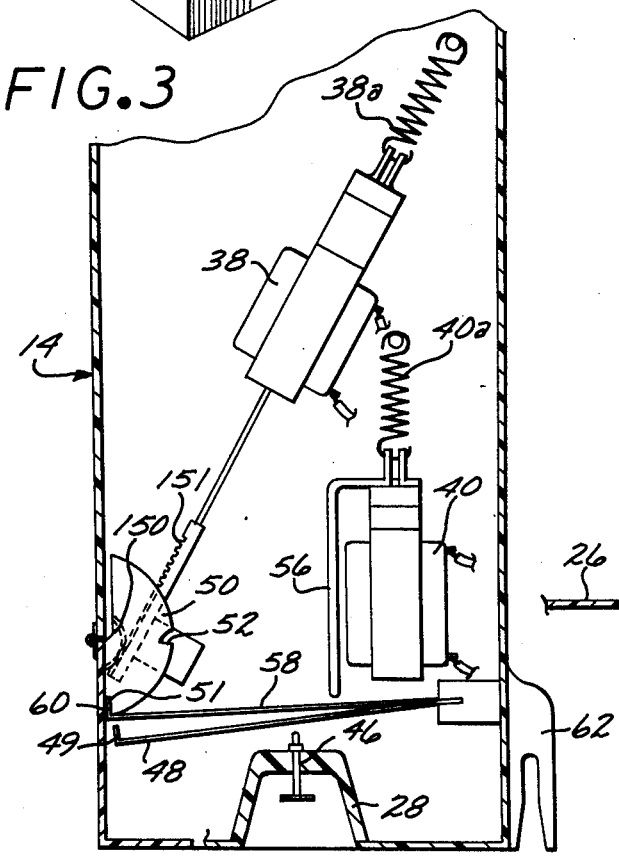
FIG. 3 is a side view, in partial cross section, taken along line 3—3 of FIG. 2.
Figure 4:
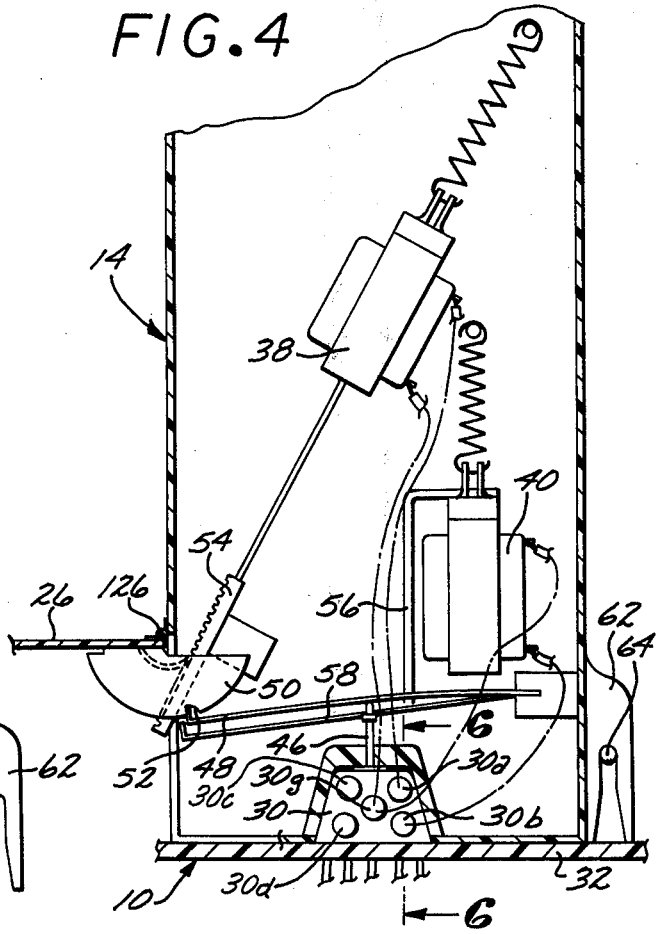
FIG. 4 is the side view shown in FIG. 3, illustrating the inventive manner of opening of the cartridge container.

As shown in FIGS. 2, 3 and 4, the cartridge container 14 is adapted for receipt within the interior of the vending machine 10 and, when received, is aligned therein by engaging two opposed studs 64 within the machine 10 between the two tines of a pair of forks 62. Forks 62 are disposed to open towards the bottom of cartridge container 14, being aligned to project in the plane of the two vertical sides 118 and 119 to the exterior of the container 14. In order to facilitate dispensing, the bottom surface of the cartridge container 14 includes a plurality of transverse slots 18 formed in the manner of cut-outs extending partly into the vertical front panel 117 of the container and continuing into the bottom panel thereof.

As shown in FIG. 8, the section of slots 18 extending along the bottom surface is received below a horizontal section 26*a* formed by folding a sheet metal transverse door 26 hinged across a hinge 126 from the back surface of container 14. Slots 18 allow for the articulation of any dispensing mechanism, such as the mechanism described in U.S. Pat. No. 3,486,658, to permit selective ejection of vended articles from within container 14 once the transverse door 26 is open.

As shown in FIGS. 3, 4 and 7, the interlock housing 114 receives, on the interior thereof, a semicircular cam 50 comprising two cam plates 50*a* and 50*b* extending at one radial edge thereof from a vertical edge of the transverse door 26 to the interior of the housing. The attachment of cam 50 to the edge of door 26 is made to align the virtual center of the cam 50 at the pivot axis of hinge 126. Included between cam plates 50*a* and 50*b* is a concentric pinion segment 150, again arranged to rotate about the pivot point of door 26, pinion segment 150 engaging a rack 151 articulated longitudinally by a solenoid 38.

Formed on the peripheral edge of cam plate 50*a* is a detent 51, and on cam plate 50*b* a detent 52, detent 51 being located along the joint of cam 50 with door 26 while detent 52 is located approximately 90° therefrom along the periphery of the cam. Detent 51 receives a bent-up end tab 60 formed on the end of a leaf spring 58 which at the other end is secured to the housing 114 with a spring bias urging tab 60 against the periphery of cam 50. The length of leaf spring 58 is controlled to align tab 60 with detent 51 when door 26 is in a normally closed position. When in this position, the normal pre-stress, or the normal spring bias, of leaf spring 58 is such that the door 26 cannot be opened until or unless an external opposing force is applied to leaf spring 58 to withdraw the tab from detent 51.

Disposed along leaf spring 58, in lateral offset, is yet another leaf spring 48, again similarly secured at one end to housing 114 together with the end of leaf spring 58, leaf spring 48 being normally biased to bend away from the peripheral edge of cam 50. The free end of leaf spring 48 is similarly bent up in a tab 49 to extend upon a proper imposition of opposing forces thereon into an engaging position with detent 52.

Leaf spring 48 is adapted to be moved against the periphery of cam 50 by a pin 46 vertically extending through the top wall of a keyway 28 formed in the bottom surface of housing 114. Pin 46 is free in translation through the wall of the keyway 28 and, upon insertion of the cartridge container 14 into the vending machine 10, abuts at the exterior, or bottom end, against a top surface of a key terminal assembly 30, for movement upwardly against the leaf spring 48.

Key terminal assembly 30 includes five exposed electrical terminals, 30*g* and 30*a*, *b*, *c*, *d*, only three of which are necessary to energize the interlock mechanism. The excess number of terminals allows for combination coding and several attempts will thus be necessary to open the interlock with the container outside of the vending machine.

More specifically, by way of one example, the combination shown includes a ground terminal, designated 30*g* and shown as the center terminal of the five-terminal grouping, and two hot terminals, respectively designated 30*a* and 30*b*. Terminal 30*a* and terminal 30*g* are connected across the solenoid 38. Terminal 30*g* and terminal 30*b* are in turn connected across a solenoid 40. Solenoid 40 includes a push rod 56 which is aligned to oppose in a downward direction leaf spring 58, against its normal bias. Accordingly, when electrical excitation is applied across terminals 30*g* and 30*b*, solenoid 40 is energized, extending push rod 56 against leaf spring 58 to thereby withdraw the end tab 60 on the leaf spring 58 out of detent 51. Concurrently, application of electrical excitation across terminals 30*a* and 30*g* applies power to solenoid 38 extending the rack 151 across the pinion 150 to rotate door 26 about the hinge 126.

It is to be noted that the leaf spring 48 is both shorter than the length of leaf spring 58 and is laterally displaced. Accordingly, the end tab 49 on leaf spring 48, driven by pin 46 to abut against the peripheral edge of cam 50, cannot engage detent 51. In this abutting position, the tab 49 is exposed to engage detent 52 after an appropriate rotation of pinion 150. In this manner, a positive interlock is formed wherein leaf spring 58 maintains door 26 normally closed and is only withdrawn from detent 51 upon proper connection of electrical excitation to solenoid 40. As shown in FIG. 6, the key terminal assembly 30, when inserted to appropriate depth, aligns terminals 30*a*, *b*, *c*, *d* and *g* with a plurality of corresponding contacts designated 28*a*, *b*, *c* (not shown), *d* (not shown) and *g* in the keyway 28, thus making appropriate connections to solenoids 38 and 40.

According to the above description, it should be noted that only momentary excitation is necessary to the solenoids in order to open door 26. Such momentary excitation is provided by way of a momentary closure microswitch 44 in series with one of the leads of cord 106, microswitch 44 being configured as a conventional push-to-momentary-closure switch, being closed by a semicircular cam 42 extending from the closure 12. Thus only a momentary signal is applied to terminals 30*a* and 30*b* during the closing stroke of closure 12. Since closure 12 is shut only after proper insertion of container 14 into the interior of machine 10, excitation of the solenoids occurs after spring 48 is brought up against cam 50 by pin 46. In this position, the door 26 is set for opening.

It should be noted that the microswitch 44 is in series with the hot lead of the power cord 106. On the output side of the microswitch, this hot lead is branched to energize both terminals 30*a* and 30*b*. The ground lead from cord 106 is pulled directly to terminal 30*g*. Since proper contact can only be made between terminals 30*a*, 30*b* and 30*g* and the corresponding contacts in the keyway 28 when pin 46 is pushed into the interior of housing 114, a proper leaf spring bias is applied to leaf spring 48. Door 26 is thereby biased to open after such excitation is made, projecting below a frame member 41 extending across the interior of the vending machine. Upon withdrawal of the cartridge container 14 from within the interior of the vending machine 10, pin 46 is free to drop down, releasing the opposing bias on leaf spring 48 and therefore allowing spring 48 to pull out of the detent 52 by the normal spring bias thereon. When full closure of door 26 is thus effected, the frame member 41 is cleared and leaf spring 58 is free to extend its end tabs 60 into the interior of detent 51. Since each solenoid includes an associated spring 38*a* and 40*a*, respectively, a release of the cam is accompanied by door rotation effected by the normal bias on solenoid 38.

As one manner of preventing repetitive external attempts at opening door 26, the other contacts, 28*c* and 28*d* (not shown), can be shorted to ground to provide a short across any external electrical source utilized to open container 14.

While reference has been made above to the prior U.S. Pat. No. 3,486,658, the particular structural elements referred to therein implementing withdrawal of articles from container 14 is again illustrated in FIG. 9. In this instance, the cartridge container 14 is illustrated as containing articles like cigarette packs 22 laid or stacked in columns, in alignment above the corresponding slots 18. Each slot 18 is aligned over a corresponding tab 101 which extends into the interior of the vending machine 10 in the form of a metal strip 74. The other end of strip 74 is bent down to engage a pin 72 secured in the free end of a pivoted arm 76. Pin 72 engages a slot 78 formed within a coin-released element 70 which is conventionally released to articulate by an appropriate insertion of coins into coin slot 104. Accordingly, the motion of tab 101 is tied to element 70 and such will occur upon receipt of the proper coins. Attached to the other end of strip 74 is a spring-loaded pusher 20 which normally is compressed downwardly by the bottom surface of the vended articles or cigarette packs 22 and which upon extension of tabs 101 from the machine 10 is free to extend upwardly to project in interference against the exposed end of the vended article. When in this position, insertion of tab 101 back into the interior of the vending machine 10 will effect a dispensing of the cigarette pack 22 through the open door 26 to fall onto a plate 82 which connects to the chute 103.

While the present invention is primarily directed at a positive interlock in a cartridge container, the additional structure required in order to effect proper dispensing of the articles from within the container can be found in many prior art descriptions. In particular, any conventional coin-operated lock may be used to release the articulation of the element 70. Similarly, any conventional interlock provisions can be made so that concurrent articulation of a plurality of tabs 101 is precluded. The location of tabs 101 is conventionally biased to a withdrawn position by a spring 80 extending between a shaft 81 and the free end of arm 76.

In a further embodiment, the inventive cartridge container 14 is insertable into a supermarket dispenser 200. As shown in FIG. 10, the supermarket dispenser 200 is again formed in the manner of a rectangular housing including an opening 201 on the upper surface thereof. Opening 201 is sized in planform to the planform dimensions of container 14 to partly receive container 14 including housing 114 within the interior thereof. The remaining section of container 14 extends above dispenser 200, forming in combination therewith an enclosure within which articles like cigarette packs 22 are received. Container 14 is in all respects similar in detail to the configuration previously described, including the inventive interlock. Dispenser 200, on the other hand, is greatly simplified over the configuration of vending machine 10, it being intended to utilize such dispenser in situations where sales personnel attendance is concurrent with vending. For example, where some inventory control over dispensed articles is required and one or a group of persons can be assigned responsibility for such control only an inventory count is necessary in any mechanized dispenser.

For such a purpose, the dispenser 200 includes a plurality of selector tabs 202 each articulated to dispense an appropriate brand of cigarettes. The selected cigarette packs 22 are dispensed through corresponding dispensing ports 203 formed in the front panel of dispenser 200 in proximity, or above, the particular selector tab.

As shown in more detail in FIG. 11, the simplified dispenser 200 is arranged to receive container 14 with the transverse door 26 thereof aligned adjacent the ports 203 so that the withdrawal of articles therefrom is on the extracting part of the stroke of tab 202. Tab 202 includes a spring-biased dog 205 on the interior end thereof which is aligned to pass through slots 18, withdrawing the articles or packs 22 from within the container. The peripheral edge of opening 201 adjacent door 26 includes a downwardly extending sheet metal membrane 206, the free bottom edge thereof terminating above the hinge 126 to permit articulation of the door 26 to an open position. Upon withdrawal, door 26 is released by releasing pin 46 in a similar manner to that shown in the previous embodiment.

Articulation of tab 202 is opposed by a spring 211 stretched between a bracket 212 attached to the interior back surface of dispenser 200 and the free end of a pivoted arm 213. Arm 213 also includes at the free end a transversely extending rod 214 which is aligned below the row of tabs 202 to be engaged by a projecting member 215 extending downwardly from each tab. When a tab 202 is withdrawn to dispense a particular pack 22, rod 215 engages a lever 216 extending from a counter 217. Counter 217 is thus conventionally incremented by one count on each dispensing of any one article.

It is to be noted that while a reversed orientation of container 14 is shown in vending machine 10 and dispenser 200, the manner of operation of the inventive interlock is essentially the same. Accordingly, it is contemplated that the dispenser 200 incorporate the keyway and terminal fitting features described by way of reference to numerals 28 and 30 above and that container 14 include similar structure in both embodiments. The function of the microswitch 44 is similarly incorporated in dispenser 200 by arranging such to be closed by a counter door 225 provided in the dispenser in alignment with counter 217. In this manner, dispenser 200 functions in a similar manner as the vending machine 10 with the exception that no coin deposit is required in the former.

The alignment of container 14 within dispenser 200 is further controlled by two slots 221 formed in the upper surface thereof, slots 221 extending rearwardly from the edge of opening 201 to permit passage of the forks 62 into the interior of dispenser 200 where they engage two opposed pins 222.

In operation, both embodiments are essentially similar. In each instance the container 14 is received within a dispensing machine and is aligned therein by the forks 62. When in position, pin 46 is translated upwardly against spring 48, urging the end tab 49 on spring 48 against the peripheral edge of cam 50. Concurrently, the terminals and contacts are aligned to provide circuit continuity to solenoids 38 and 40. Upon a momentary closure effected by microswitch 44, both solenoids are energized, one articulating door 26 by a rack and pinion drive, while the other withdrawing spring 58 from detent 51. Solenoids 38 and 40 are conveniently spring biased by associated springs **38*a* and 40*a* to return when not excited, solenoid 38 being maintained in extended position by the engagement of the rack 151 with the pinion 150.**

Upon withdrawal of the container 14, pin 46 falls away from spring 48 releasing the door 26 which is then pulled closed by the passive bias on solenoid 38. Upon reaching a closed state, detent 51 is engaged, precluding further withdrawal of articles.

Some of the many advantages of the present invention should now be readily apparent. As disclosed, the invention teaches a positive interlocking mechanism which only draws a minimal amount of power during the unlocking sequence. Pilferage from the enclosed cartridge container is further precluded by a larger-than-required number of terminals which therefore provide for many more combinations than those necessary to effect an opening.

Obviously, many modifications and variations of the present invention may be made with regard to the foregoing detailed description without departing from the spirit of the invention.

What is claimed is:

1. An electro-mechanical interlock for a cartridge insertable into a vending machine and adapted to enclose vended articles for dispensing from said vending machine, said interlock comprising:

door means connected to said cartridge container for pivotal movement between open and closed positions to control the removal of said articles from said container, said door means including latch means attached thereto for pivotal movement therewith;

electrical terminal means mounted in said vending machine for providing a source of electrical power;

electrical contact means mounted on said container for contacting said terminal means upon insertion of said container into said vending machine;

a first spring attached to said container and engaging said latch means when said door means is in said closed position to maintain said door means in said closed position;

a second spring attached to said container and normally located out of engagement with said latch means, said second spring being adapted to be urged into engagement with when said door means is in said open position to maintain said door means in said open position;

urging means movable into said container, for urging said second spring into said engagement with said latch means, upon insertion of said container into said vending machine; and solenoid means connected to said contact means to derive electrical power therefrom and operative for pivoting said door to said open position and for concurrently urging said first spring out of said engagement with said latch means, said solenoid means being operative upon contact between said contact means and said terminal means.

2. Apparatus according to claim 1 further comprising:

microswitch means interposed between said electrical terminal means and a source of electrical power and operative to electrically energize said terminal means.

3. Apparatus according to claim 1 wherein:

said pivoted door means includes a door pivotally mounted along one edge thereof to said cartridge container; and said latch means includes a semicircular cam connected along one radius thereof to one pivotal edge of said door means.

4. Apparatus according to claim 3 wherein:

said semicircular cam further includes a first and second detent, laterally offset and formed on the peripheral edge thereof; and said first and second springs are attached to said container in laterally offset relation to respectively engage said first and second detents.

5. Apparatus according to claim 4 wherein:

said first spring engages said first detent with the door in said closed position, and said second spring is adapted to engage said second detent with the door in said open position.

6. In a vending machine including vending means for selectively dispensing vended articles, the improvement comprising:

a container adapted to store said articles and conformed for insertion in said vending machine;

a door connected to said container for pivotal movement between open and closed positions to control the removal of articles from said container;

latch means attached to said door for pivotal movement therewith;

electrical terminal means mounted in said vending machine for providing a source of electrical power;

electrical contact means mounted on said container for connecting to said terminal means upon insertion of said container into said vending machine;

spring means adapted to engage said latch means in said closed position of said door, when said container is outside of said vending machine, to maintain said door in said closed position, and operative to disengage said latch means to permit said door to pivot to said open position when said container is inserted within said vending machine; and electrically energizable means connected to said contact means and operative upon insertion of said container into said vending machine to operate said spring means to disengage said spring means from said latch means, and concurrently pivot said door to said open position.

7. Apparatus according to claim 6 wherein said energizable means comprises:

solenoid means connected to said contact means for operating said spring means to disengage said spring means from said latch means and for pivoting said door to said open position upon insertion of said container within said vending machine; and further including urging means operative only upon insertion of said container into said vending machine for urging said spring means into engagement with said latch means in said open position of said door to maintain said door in said open position.

8. Apparatus according to claim 7 wherein:

said spring means includes a first spring attached to said container and engaging said latch means when said door is in said closed position to maintain said door in said closed position, a second spring attached to said container and noramlly located out of engagement with said latch means, said second spring being adapted to be urged into engagement with said latch means when said door is in said open position to maintain said door in said open position; and said urging means includes a pin through the wall of said container to engage and move said second spring against said latch means upon insertion of said container into said vending machine.

9. Apparatus according to claim 8 further comprising:

microswitch means interposed between said electrical terminal means and a source of electrical power for momentarily energizing said terminal means upon operation of said microswitch means.

10. Apparatus according to claim 9 wherein:

said latch means comprises a semicircular cam connected along one radius thereof to one pivotal edge of said door, the periphery of said cam including first and second laterally offset detents; and said first and second springs are attached to said container in laterally offset relation for engagement with said first and second detents, respectively.

* * * * *